US011467518B2

(12) United States Patent
Yamashita et al.

(10) Patent No.: US 11,467,518 B2
(45) Date of Patent: Oct. 11, 2022

(54) IMAGE FORMING DEVICE WITH INFRARED HEATER AND REFLECTIVE CONVEYING UNIT

(71) Applicant: FUJIFILM Business Innovation Corp., Tokyo (JP)

(72) Inventors: Masato Yamashita, Ebina (JP); Takayuki Yamashita, Ebina (JP); Tetsuro Kodera, Ebina (JP); Yoshiki Shimodaira, Ebina (JP); Kosuke Yamada, Ebina (JP); Tokuya Sakamoto, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/335,973

(22) Filed: Jun. 1, 2021

(65) Prior Publication Data

US 2021/0286298 A1 Sep. 16, 2021

Related U.S. Application Data

(63) Continuation of application No. PCT/JP2019/029536, filed on Jul. 26, 2019.

(30) Foreign Application Priority Data

Feb. 12, 2019 (JP) ..... JP2019-022600

(51) Int. Cl.
*G03G 15/20* (2006.01)

(52) U.S. Cl.
CPC ..... *G03G 15/2028* (2013.01); *G03G 15/20* (2013.01); *G03G 15/2007* (2013.01)

(58) Field of Classification Search
CPC ..... G03G 15/2007
See application file for complete search history.

(56) References Cited

U.S. PATENT DOCUMENTS 5,475,788 A 12/1995 Classens et al.
5,890,032 A * 3/1999 Aslam ..... G03G 15/2039 399/329
5,983,048 A 11/1999 Moser

FOREIGN PATENT DOCUMENTS

JP S58-009175 A 1/1983
JP H06-194983 A 7/1994
(Continued)

OTHER PUBLICATIONS

JP_2002148973_A_T Machine Translation, Japan, 2002, Hirokazu.*
(Continued)

*Primary Examiner* — Victor Verbitsky
(74) *Attorney, Agent, or Firm* — Oliff PLC

(57) ABSTRACT

Provided is an image forming device including: a conveying unit configured to convey a recording medium while rotating, in a state of being in contact with a back surface of the recording medium having a front surface on which a toner image is transferred; a main heating unit configured to heat the conveyed recording medium to fix the toner image on the recording medium; and a preheating unit disposed upstream of the main heating unit in a conveying direction of the recording medium and configured to heat, in a non-contact state, the recording medium being conveyed by the conveying unit, a portion of the conveying unit that is in contact with the recording medium being formed of a material that makes a maximum temperature of the portion be equal to or lower than a temperature of the recording medium when the recording medium is heated by the preheating unit.

12 Claims, 9 Drawing Sheets

(56) References Cited

FOREIGN PATENT DOCUMENTS

| | | | | |
|---|---|---|---|---|
| JP | 2002-148973 | A | | 5/2002 |
| JP | 2002148973 | A | * | 5/2002 |
| JP | 2004-151475 | A | | 5/2004 |
| JP | 2009-288491 | A | | 12/2009 |
| JP | 2015-011269 | A | | 1/2015 |

OTHER PUBLICATIONS

Aug. 27, 2019 International Search Report issued in International Patent Application No. PCT/JP2019/029536.
Aug. 27, 2019 Written Opinion issued in International Patent Application No. PCT/JP2019/029536.

* cited by examiner

IMAGE FORMING DEVICE WITH INFRARED HEATER AND REFLECTIVE CONVEYING UNIT

CROSS REFERENCE TO RELATED APPLICATIONS

This is a continuation of International Application No. PCT/JP2019/029536 filed on Jul. 26, 2019, and claims priority from Japanese Patent Application No. 2019-022600 filed on Feb. 12, 2019.

BACKGROUND

Technical Field

The present invention relates to an image forming device.

Related Art

In an image forming device disclosed in Patent Literature 1, by rotating a conveying pulley by a rotary drive source, a conveying member and a conveying auxiliary member are driven to convey a transfer material, an unfixed toner image is heated and melted by radiation heat, and the transfer material is conveyed to a guide member at an inlet of a calender roller.

CITATION LIST

Patent Literature

Patent Literature 1: JP-A-2002-148973

SUMMARY

In the related art, an image forming device includes: a conveying unit that conveys a recording medium while rotating in a state of being in contact with a back surface of the recording medium having a front surface where a toner image is transferred; and a preheating unit that heats the recording medium conveyed by the conveying unit. Further, the image forming device includes a main heating unit that fixes the toner image to the recording medium heated by the preheating unit.

When the preheating unit heats the recording medium, if a temperature of a portion of the conveying unit that is in contact with the recording medium is higher than a temperature of the recording medium, heat of the conveying unit is transferred to the recording medium. Since the conveying unit conveys the recording medium while rotating, the temperature of the conveying unit gradually rises due to the heating of the preheating unit.

In a case of forming an image on a plurality of recording media, when the heat of the conveying unit is transmitted to the recording media, the temperature of the conveying unit gradually rises in this way. For example, a difference in temperature is generated between a first recording medium and a 100th recording medium that are heated by the preheating unit. Therefore, a difference is generated between glossiness of an image formed on the first recording medium and glossiness of an image formed on the 100th recording medium.

Aspects of non-limiting embodiments of the present disclosure relate to reduce variation in glossiness among images continuously formed on many recording media caused by the rise of a temperature of a portion of a conveying unit that is in contact with a recording medium when a preheating unit heats the recording medium.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming device including: a conveying unit configured to convey a recording medium while rotating, in a state of being in contact with a back surface of the recording medium having a front surface where a toner image is transferred; a main heating unit configured to heat the conveyed recording medium to fix the toner image on the recording medium; and a preheating unit disposed upstream of the main heating unit in a conveying direction of the recording medium and configured to heat, in a non-contact state, the recording medium being conveyed by the conveying unit. A portion of the conveying unit that is in contact with the recording medium is formed of a material that makes a maximum temperature of this portion be equal to or lower than a temperature of the recording medium when the recording medium is heated by the preheating unit.

BRIEF DESCRIPTION OF DRAWINGS

Exemplary embodiment(s) of the present invention will be described in detail based on the following figures, wherein.

DETAILED DESCRIPTION

Figure 1:
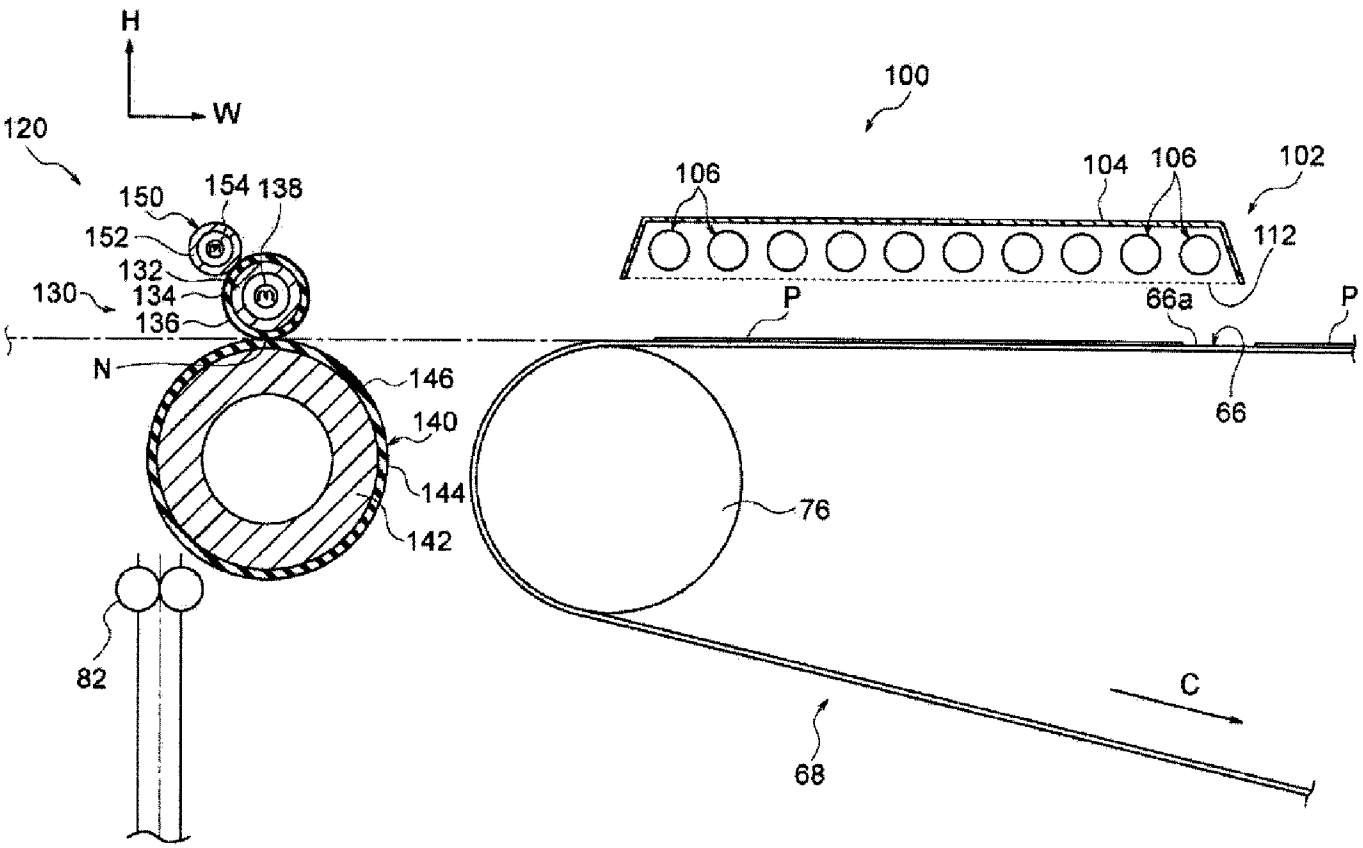
FIG. 1 is a configuration diagram showing a fixing device of an image forming device according to an exemplary embodiment of the present invention.

An exemplary embodiment of an image forming device will be described with reference to FIGS. 1 to 9. In the drawings, an arrow H indicates a device upper-lower direction (vertical direction), an arrow W indicates a device width direction (horizontal direction), and an arrow D indicates a device depth direction (horizontal direction).

(Image Forming Device 10)

Figure 8:
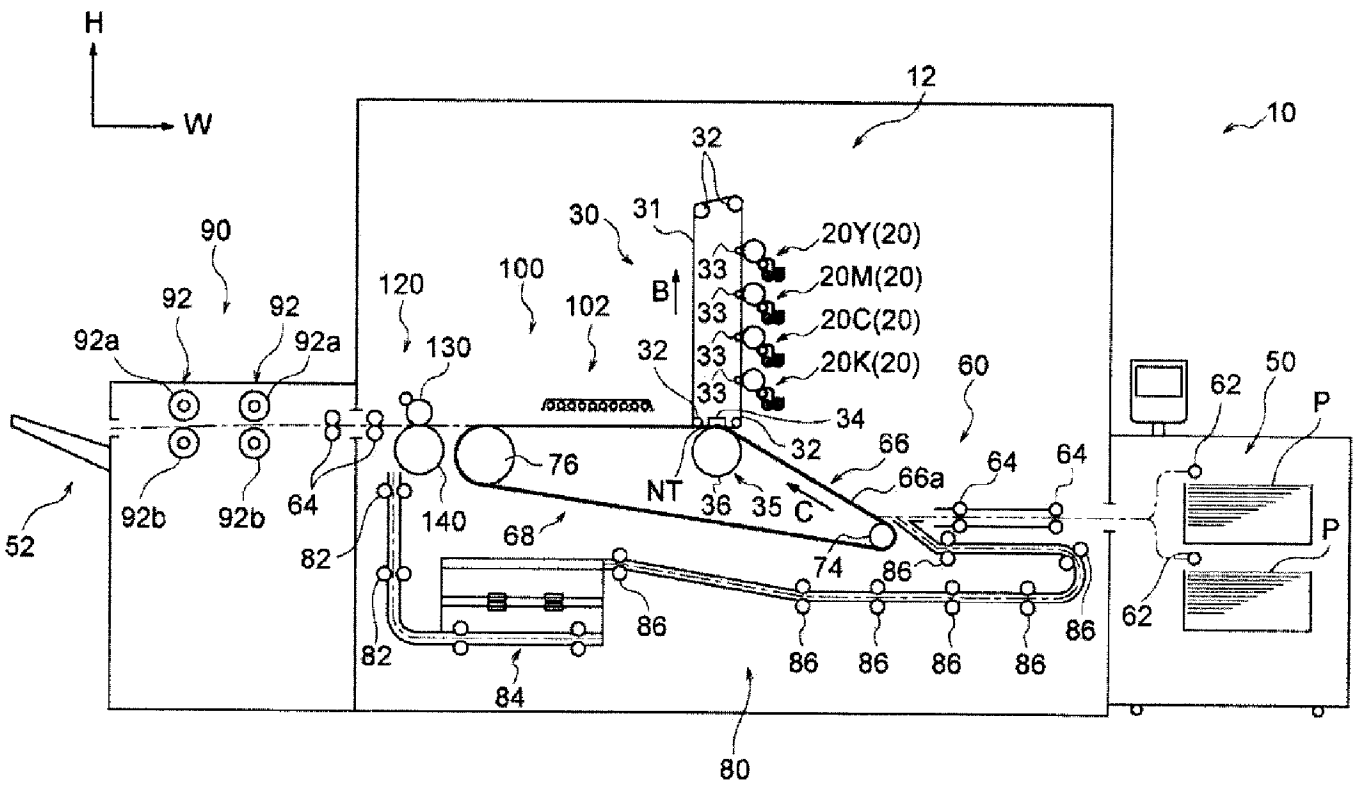
FIG. 8 is a schematic configuration diagram showing the image forming device according to the exemplary embodiment of the present invention.

An image forming device 10 according to the exemplary embodiment is an electrophotographic image forming device that forms a toner image on a sheet member P. As shown in FIG. 8, the image forming device 10 includes an accommodating portion 50, a discharge portion 52, an image forming unit 12, a conveying mechanism 60, a reversing mechanism 80, a fixing device 100, and a cooling unit 90.

[Accommodating Portion 50]

The accommodating portion 50 has a function of accommodating the sheet member P as a recording medium. The image forming device 10 may include a plurality of (for example, two) accommodating portions 50, and may selectively send out the sheet member P from the plurality of accommodating portions 50.

[Discharge Portion 52]

The discharge portion 52 is a portion where the sheet member P on which the toner image is formed is discharged. Specifically, after the toner image is fixed by the fixing device 100, the sheet member P cooled by the cooling unit 90 is discharged to the discharge portion 52.

[Image Forming Unit 12]

The image forming unit 12 has a function of forming a toner image on the sheet member P in an electrophotographic method. Specifically, the image forming unit 12 includes a toner image forming unit 20 that forms a toner image, and a transfer device 30 that transfers the toner image formed by the toner image forming unit 20 to the sheet member P.

A plurality of toner image forming units 20 are provided so as to form a toner images for each color. The image forming device 10 includes toner image forming units 20 of a total of four colors of yellow (Y), magenta (M), cyan (C), and black (K). The (Y), (M), (C), and (K) shown in FIG. 8 show constituent portions corresponding to the respective colors.

—Toner Image Forming Unit 20—

Figure 7:
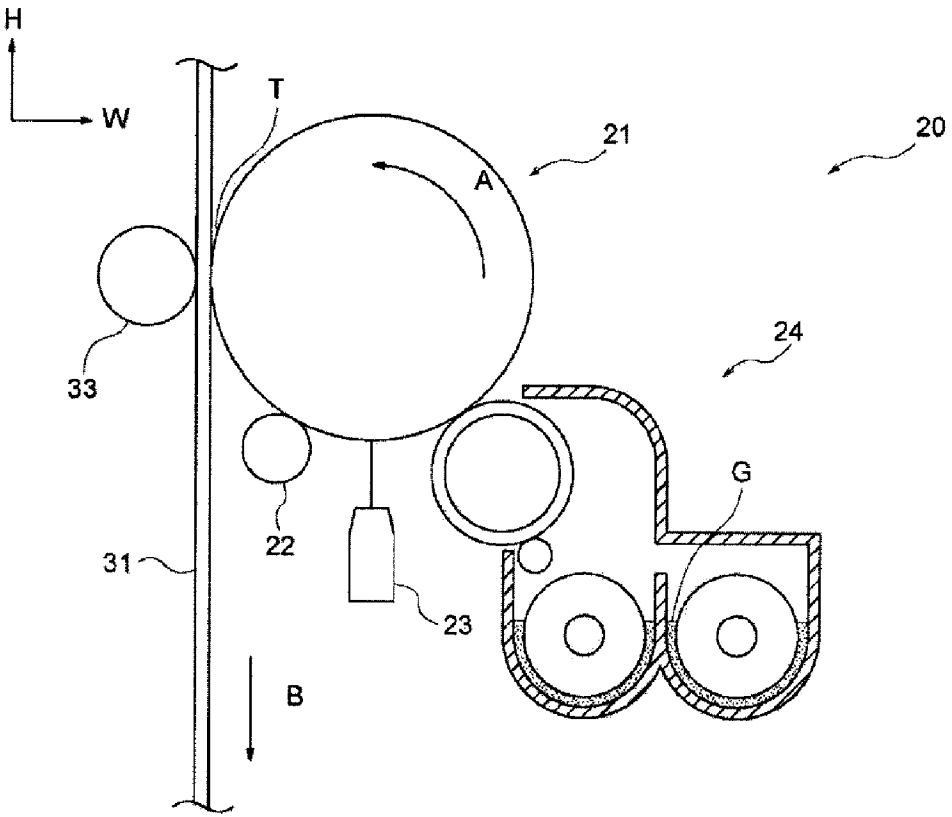
FIG. 7 is a configuration diagram showing a toner image forming unit of the image forming device according to the exemplary embodiment of the present invention.

The toner image forming units 20 of these colors have basically the same configuration except for toner to be used. Specifically, as shown in FIG. 7, the toner image forming unit 20 of each color includes a photosensitive drum 21 (photoconductor) that rotates in a direction indicated by an arrow A in FIG. 7, and a charger 22 that charges the photosensitive drum 21. Further, the toner image forming unit 20 of each color includes an exposure device 23 that exposes the photosensitive drum 21 charged by the charger 22 to light to form an electrostatic latent image on the photosensitive drum 21, and a developing device 24 that uses toner to develop the electrostatic latent image, that is formed on the photosensitive drum 21 by the exposure device 23, so as to form a toner image.

—Transfer Device 30—

The transfer device 30 has a function of primarily transferring a toner image of the photosensitive drum 21 of each color onto an intermediate transfer body in a superimposed manner, and secondarily transferring the superimposed toner image onto the sheet member P. Specifically, as shown in FIG. 8, the transfer device 30 includes a transfer belt 31 as the intermediate transfer body, primary transfer rollers 33, and a transfer unit 35.

The primary transfer roller 33 has a function of transferring the toner image formed on the photosensitive drum 21 to the transfer belt 31 at a primary transfer position T (see FIG. 7) between the photosensitive drum 21 and the primary transfer roller 33.

The transfer belt 31 has an endless shape, and is wound around a plurality of rollers 32 to determine a posture thereof. When at least one of the plurality of rollers 32 is driven to rotate, the transfer belt 31 rotates in a direction indicated by an arrow B, and conveys the primarily transferred toner image to a second transfer position NT to be described later.

The transfer unit 35 has a function of transferring the toner image, that is transferred to the transfer belt 31, to the sheet member P. Specifically, the transfer unit 35 includes a second transfer unit 34 and a facing roller 36.

The facing roller 36 is disposed below the transfer belt 31 so as to face the transfer belt 31. The second transfer unit 34 is disposed inside the transfer belt 31 such that the transfer belt 31 is disposed between the second transfer unit 34 and the facing roller 36. Specifically, the secondary transfer unit 34 is configured with a corotron. In the transfer unit 35, the toner image transferred to the transfer belt 31 is transferred to the sheet member P passing through the second transfer position NT by an electrostatic force generated due to discharge of the secondary transfer unit 34. Here, the second transfer position NT is a position where the transfer belt 31 and the facing roller 36 are in contact with each other.

[Conveying Mechanism 60]

The conveying mechanism 60 has a function of conveying the sheet member P accommodated in the accommodating portion 50 to the second transfer position NT. Further, the conveying mechanism 60 has a function of conveying the sheet P from the second transfer position NT to the main heating unit 120 to be described later. The conveying mechanism 60 will be described in detail later.

[Reversing Mechanism 80]

As shown in FIG. 8, the reversing mechanism 80 includes a plurality of conveying rollers 82, a reversing device 84, and a plurality of conveying rollers 86.

The plurality of conveying rollers 82 are rollers that convey the sheet member P fed from the fixing device 100 to the reversing device 84. The reversing device 84 is, for example, a device that rotates while conveying the sheet member P a plurality of times so as to change a conveying direction of the sheet member P by, for example, 90 degrees, thereby twisting the sheet member P as a mevius band and reversing the front and back of the sheet member P.

The plurality of conveying rollers 86 are rollers that convey the sheet member P, whose front and back are reversed by the reversing device 84, to the conveying mechanism 60.

In the configuration, when a toner image is to be formed on a first surface (front surface) and a second surface (back surface) of the sheet member P (hereinafter, may be referred to as "double-sided printing"), the reversing mechanism 80 reverses front and back of the sheet member P in which the toner image is fixed on the first surface (front surface) by the fixing device 100. Then, the reversing mechanism 80 conveys the sheet member P to the second transfer position NT again through the conveying mechanism 60.

[Fixing Device 100]

The fixing device 100 has a function of fixing the toner image, which is transferred to the sheet member P by the transfer device 30, to the sheet member P. The fixing device 100 will be described in detail later.

[Cooling Unit 90]

The cooling unit 90 has a function of cooling the sheet member P heated by the fixing device 100. As shown in FIG. 8, the cooling unit 90 is disposed downstream of the main heating unit 120 to be described later in the conveying direction of the sheet member P. The cooling unit 90 includes two cooling rollers 92 arranged in the device width direction. Since the two cooling rollers 92 have the same configuration, one of the cooling rollers 92 will be described.

Figure 6:
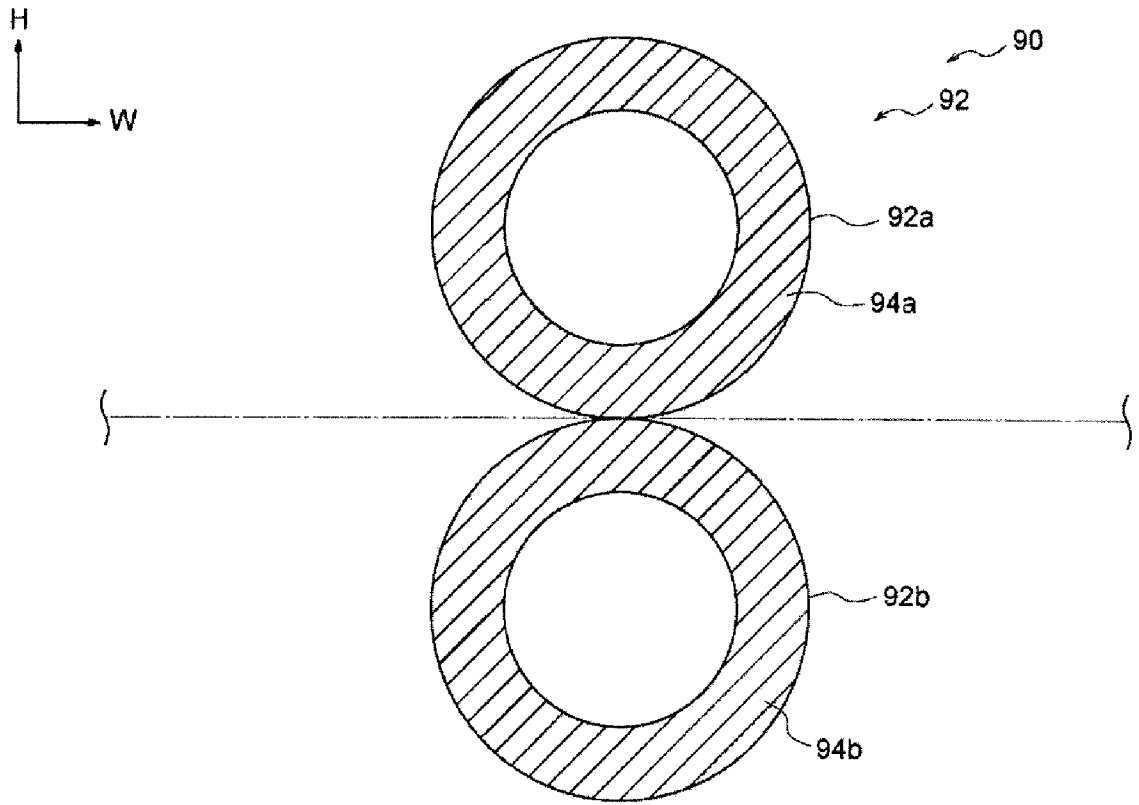
FIG. 6 is a cross-sectional view showing a cooling unit of the image forming device according to the exemplary embodiment of the present invention.

As shown in FIG. 6, the cooling rollers 92 includes a pair of rollers 92*a*, 92*b* that sandwich a conveying path of the sheet member P. The roller 92*a* is disposed above the conveying path of the sheet member P. The roller 92*b* is disposed below the conveying path of the sheet member P.

The rollers 92*a*, 92*b* include cylindrical base members 94*a*, 94*b* extending in the device depth direction. The base members 94*a*, 94*b* are, for example, aluminum tubes. An air blowing mechanism (not shown) is configured to generate a flow of air inside the base members 94*a*, 94*b*. Due to the air flow, temperatures of surfaces of the rollers 92*a*, 92*b* are lower than temperatures in a case where there is no air flow.

In the configuration, the roller 92*b* is rotated by a rotational force transmitted from a driving member (not shown). Further, the roller 92*a* is rotated following the roller 92*b*. The rollers 92*a*, 92*b* convey the sheet member P while sandwiching the sheet member P therebetween, and cool the sheet member P.

(Operation of Image Forming Device)

In the image forming device 10 shown in FIG. 8, a toner image is formed as follows.

First, the chargers 22 of the respective colors shown in FIG. 7 to each of which a voltage is applied uniformly charge surfaces of the photosensitive drums 21 of the respective colors at a predetermined negative potential. Subsequently, based on image data received from the outside, the exposure device 23 emits exposure light to the surface of the charged photosensitive drum 21 of each color so as to form an electrostatic latent image.

Accordingly, an electrostatic latent image corresponding to the image data is formed on the surface of each photosensitive drum 21. Further, the developing device 40 of each color develops the electrostatic latent image to form a toner image on the surface of the photosensitive drum 21 of each color. The transfer device 30 transfers the toner image formed on the surface of the photosensitive drum 21 of each color to the transfer belt 31.

On the other hand, the sheet member P is sent out from the accommodating portion 50 shown in FIG. 8 to a conveying path of the sheet member P by the conveying mechanism 60 to be described later. The sheet member P conveyed along the conveying path is sent to the second transfer position NT where the transfer belt 31 and the facing roller 36 are in contact with each other. At the second transfer position NT, the sheet member P is conveyed while being sandwiched between the transfer belt 31 and the facing roller 36, and thus the toner image on the surface of the transfer belt 31 is transferred to the first surface (front surface) of the sheet member P.

Further, the fixing device 100 fixes the toner image transferred on the first surface of the sheet member P to the sheet member P, and conveys the sheet member P to the cooling unit 90. The cooling unit 90 cools the sheet member P to which the toner image is fixed, and discharges the sheet member P to the discharge portion 52.

Meanwhile, when a toner image is to be formed on the second surface (back surface) of the sheet member P, the sheet member P that is conveyed by the conveying mechanism 60 and passes through the fixing device 100 is conveyed to the reversing mechanism 80. The front and back of the sheet member P conveyed to the reversing mechanism 80 is reversed by the reversing device 84. The conveying rollers 86 convey the sheet member P whose front and back sides are reversed to the conveying mechanism 60. Further, in order to form a toner image on the second surface of the sheet member P, conveying of the sheet member P to the second transfer position NT, transfer of the toner image to the second surface of the sheet member, and fixing of the toner image to the second surface are performed in the same manner as described above.

(Configuration of Main Parts)

Next, the fixing device 100 and the conveying mechanism 60 will be described.

[Fixing Device 100]

As shown in FIG. 1, the fixing device 100 includes a preheating unit 102 that heats, in a non-contact state, the sheet member P that is conveyed in a state of being electrostatically attracted to an outer peripheral surface 66*a* of a conveying belt 66 to be described later, and the main heating unit 120 that is in contact with the sheet member P and heats and pressurizes the sheet member P.

[Preheating Unit 102]

As shown in FIG. 1, the preheating unit 102 is disposed downstream of the second transfer position NT (see FIG. 8) in the conveying direction of the sheet member P and above the sheet member P (a side on which the toner image is transferred) conveyed while being electrostatically attracted to the outer peripheral surface 66*a* of the conveying belt 66 to be described later. The preheating unit 102 includes a reflecting plate 104, a plurality of infrared heaters 106 (hereinafter referred to as "heaters 106"), and a wire mesh 112.

—Reflecting Plate 104—

The reflecting plate 104 is formed using an aluminum plate, and has a shallow box shape having an open bottom on a side of the conveyed sheet member P. In the present embodiment, when viewed from above, the reflecting plate 104 covers the conveyed sheet member P in the device depth direction.

—Heater 106—

The heater 106 has a cylindrical shape extending in the device depth direction, and a plurality of the heaters 106 are accommodated inside the box shape of the reflecting plate 104. In the exemplary embodiment, when viewed from above, each heater 106 covers the conveyed sheet member P in the device depth direction. Each heater 106 is separated from the conveyed sheet member P, for example, by 30 mm in an upward direction.

The plurality of heaters 106 are arranged at intervals in the device width direction. In the exemplary embodiment, when viewed from above, a region where the plurality of heaters 106 are arranged covers one conveyed sheet member P in the device width direction. In other words, the plurality of heaters 106 heat the entire conveyed sheet member P at a time.

The heater 106 includes a cylindrical quartz tube 108 and a carbon filament accommodated in the quartz tube. A black infrared radiation film is formed on a surface of the quartz tube 108. Thus, by forming the black infrared radiation film on the surface of the quartz tube 108, the heater 106 efficiently radiates infrared rays, for example, as compared with a case where a white film is formed. Here, in the exemplary embodiment, black is a color in which a deviation in chromaticity from an achromatic point (x=0.333, y=0.333, Y=0) is within 100 in color difference ΔE.

In the above configuration, the heater 106 radiates infrared rays having a maximum spectral radiance at a wavelength of 3 μm or more and 5 μm or less, and a surface temperature of the heater 106 is a predetermined temperature of 300° C. or more and 1175° C. or less.

Figure 4:
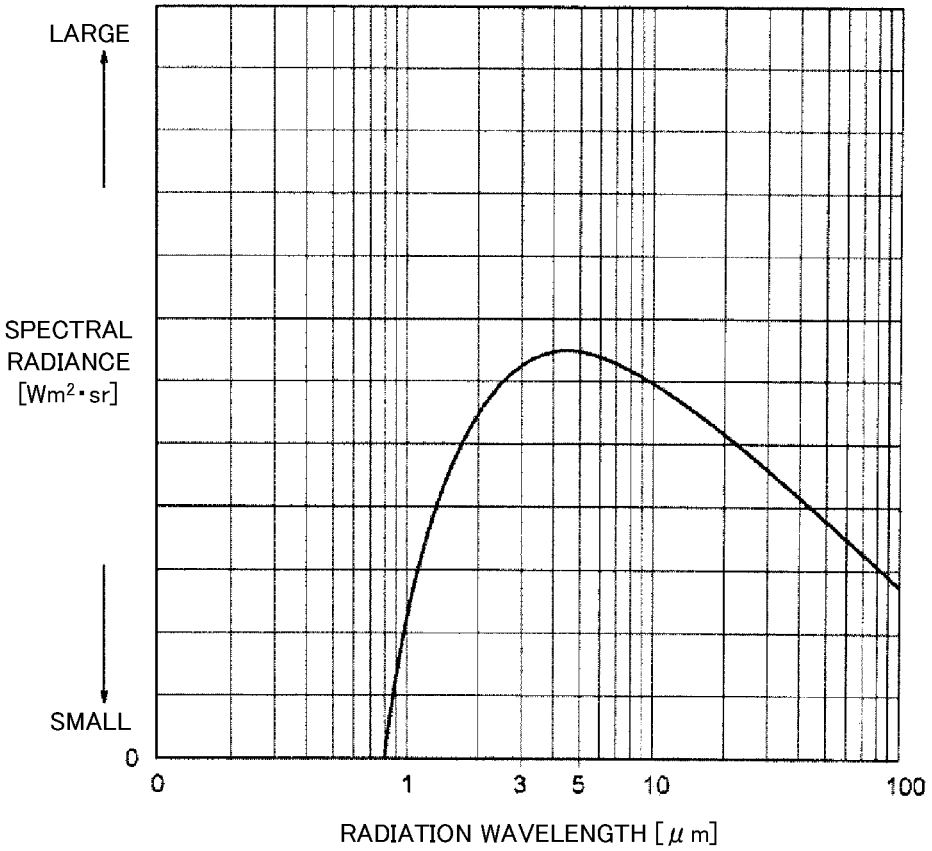
FIG. 4 is a graph showing characteristics of infrared rays emitted from a preheating unit of the image forming device according to the exemplary embodiment of the present invention.

Here, a relationship between a wavelength of the infrared rays radiated from the heater 106 and the spectral radiance will be described with reference to a graph shown in FIG. 4. In the graph of FIG. 4, a horizontal axis represents the wavelength [μm] of the infrared rays, and a vertical axis represents the spectral radiance [$W/m^2 \cdot sr$]. As shown in the graph of FIG. 4, in the infrared rays radiated from the heaters 106, the spectral radiance is maximized when a wavelength is 3 μm or more and 5 μm or less. In other words, a wavelength (peak wavelength) at which the spectral radiance has a peak is 3 μm or more and 5 μm or less.

Here, the preheating unit 102 has a function of softening the toner before the unfixed toner image is fixed to the sheet member P in the main heating unit 120. That is, the preheating unit 102 functions as a toner softening unit. The toner used in the exemplary embodiment includes a total of four types of toners including a yellow (Y) color Y toner, a magenta (M) color M toner, a cyan (C) color C toner, and a black (K) color black toner.

The heat absorption efficiency of the Y toner, the M toner, and the C toner, which are different in color from the K toner, is lower than the heat absorption efficiency of the K toner when the peak wavelength is short. That is, when the peak wavelength is short, the Y toner, the M toner, and the C toner are less likely to be softened as compared with the K toner. Meanwhile, when the peak wavelength is too long, a temperature of the heaters 106 becomes low.

In the exemplary embodiment, the peak wavelength is 3 μm or more and 5 μm or less. Therefore, the heat absorption efficiency of each of the toners of the four colors is increased, and the temperature of the heaters 106 is prevented from being lowered. As a result, the toner of each color is effectively softened by the preheating unit 102.

—Wire Mesh 112—

The wire mesh 112 is fixed to an edge portion of the box-shaped opening of the reflecting plate 104 by a fixing member (not shown), and partitions an inside of the box-shaped reflecting plate 104 from an outside of the reflecting plate 104 as shown in FIG. 1. Thus, the wire mesh 112 prevents the conveyed sheet member P from coming into contact with the heaters 106 inside the box shape of the reflecting plate 104.

In the configuration, the preheating unit 102 heats, in a non-contact state, the sheet member P from a unfixed toner image side of the sheet member P electrostatically attracted to the outer peripheral surface 66*a* of the conveying belt 66.

[Main Heating Unit 120]

As shown in FIG. 1, the main heating unit 120 is disposed downstream of the preheating unit 102 in the conveying direction of the sheet member P so as to receive the sheet member P conveyed from the conveying belt 66. The main heating unit 120 includes a heating roller 130 that comes into contact with the sheet member P to heat the sheet member P, a pressure roller 140 that presses the sheet member P toward the heating roller 130, and a driven roller 150 that is rotated following the rotating heating roller 130.

—Heating Roller 130—

As shown in FIG. 1, the heating roller 130 is disposed so as to come into contact with an upward surface of the conveyed sheet member P and extend in the device depth direction with an axial direction as the device depth direction. The heating roller 130 includes a cylindrical base member 132, a rubber layer 134 formed so as to cover an entire periphery of the base member 132, a release layer 136 formed so as to cover an entire periphery of the rubber layer 134, and a heater 138 accommodated inside the base member 132. An outer diameter of an outer peripheral surface of the release layer 136 of the heating roller 130 is, for example, 80 mm.

The base member 132 is an aluminum tube and has a thickness of 20 mm, for example. The rubber layer 134 is made of silicone rubber, and has a thickness of 6 mm, for example. Further, the release layer 136 is made of a copolymer (PFA resin) of tetrafluoroethylene and perfluoroethylene, and has a thickness of 50 μm, for example.

Figure 2:
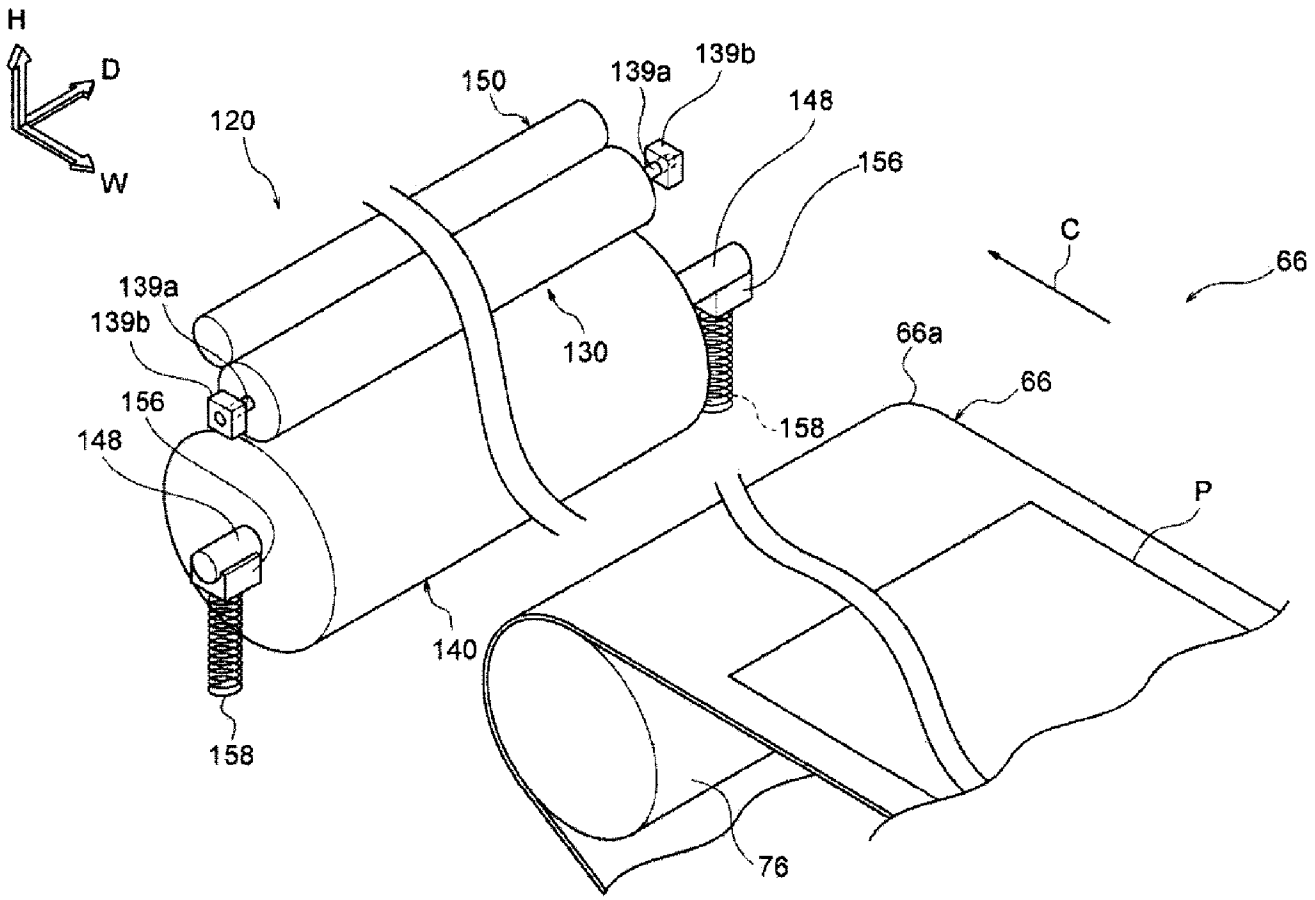
FIG. 2 is a perspective view showing a main heating unit of the fixing device of the image forming device according to the exemplary embodiment of the present invention.

As shown in FIG. 2, shaft portions 139*a* extending in the device depth direction are formed at both end portions of the heating roller 130 in the device depth direction. Each of the shaft portions 139*a* is supported by a support member 139*b*. The heating roller 130 is rotatably supported by the support members 139*b* at both end portions of the heating roller 130.

—Driven Roller 150—

As shown in FIGS. 1 and 2, the driven roller 150 is disposed opposite the conveyed sheet member P with respect to the heating roller 130 and to extend in the device depth direction with an axial direction as the device depth direction. The driven roller 150 includes a cylindrical base member 152 and a heater 154 accommodated inside the base member 152. An outer diameter of an outer peripheral surface of the base member 152 of the driven roller 150 is, for example, 50 mm.

The base member 152 is an aluminum tube and has a thickness of 10 mm, for example. The driven roller 150 is rotatably supported by support members (not shown) at both end portions of the driven roller 150.

In the configuration, the driven roller 150 is rotated following the heating roller 130. The driven roller 150 heats the heating roller 130. In this way, the heating roller 130 is heated by the driven roller 150 and the heating roller 130 itself includes the heater 138, and thus a surface temperature of the heating roller 130 becomes a predetermined temperature of 180° C. or more and 200° C. or less.

—Pressure Roller 140—

As shown in FIGS. 1 and 2, the pressure roller 140 is provided opposite the heating roller 130 with respect to the conveyed sheet member P, and is disposed to be brought into contact with a downward surface of the conveyed sheet member P, and to extend in the device depth direction with an axial direction as the device depth direction. The pressure roller 140 includes a cylindrical base member 142, a rubber layer 144 formed so as to cover the base member 142, a release layer 146 formed so as to cover the rubber layer 144, and a pair of shaft portions 148 (see FIG. 2) formed at both end portions in the device depth direction. An outer diameter of an outer peripheral surface of the release layer 146 of the pressure roller 140 is, for example, 225 mm. Thus, the outer diameter of the pressure roller 140 is larger than the outer diameter of the heating roller.

The base member 142 is an aluminum tube and has a thickness of 20 mm, for example. The rubber layer 144 is made of silicone rubber, and has a thickness of 1 mm, for example. Further, the release layer 146 is formed of a copolymer (PFA resin) of tetrafluoroethylene and perfluoroethylene, and has a thickness of 50 μm, for example.

As shown in FIG. 2, the pair of shaft portions 148 are formed at both end portions of the pressure roller 140 in the device depth direction, each have a diameter smaller than that of the outer peripheral surface of the release layer 146 of the pressure roller 140, and extend in the axial direction.

In the configuration, the pressure roller 140 is rotated by a rotational force transmitted from a driving member (not shown). Then, the heating roller 130 is rotated following the rotating pressure roller 140, and the driven roller 150 is rotated following the rotating heating roller 130. The heating roller 130 and the pressure roller 140 conveys the sheet member P to which the toner image is transferred while sandwiching the sheet member P, and thus the toner image is fixed to the sheet member P.

—Others—

As shown in FIG. 2, the main heating unit 120 includes support members 156 that support the pressure roller 140, and biasing members 158 that bias the pressure roller 140 toward the heating roller 130 via the support members 156.

A pair of support members 156 are disposed so as to rotatably support the pair of shaft portions 148 of the pressure roller 140 from below.

A pair of biasing members 158 are compression springs, and are disposed opposite the shaft portions 148 with respect to the support members 156.

Figure 5:
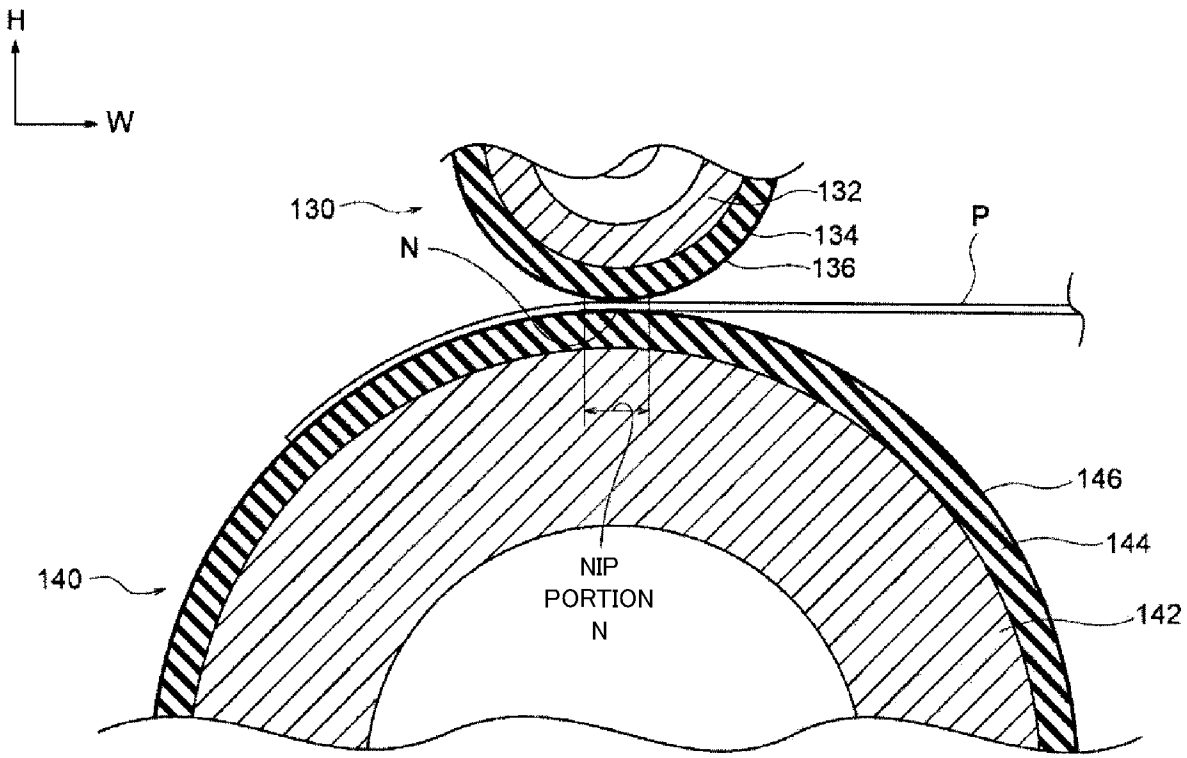
FIG. 5 is a cross-sectional view showing the main heating unit of the fixing device of the image forming device according to the exemplary embodiment of the present invention.

In the configuration, the pair of biasing members 158 bias the pressure roller 140 toward the heating roller 130, and thus the pressure roller 140 presses the sheet member P toward the heating roller 130. Then, as shown in FIG. 5, a portion of the heating roller 130 that is biased by the pressure roller 140 is deformed, and a nip portion N that is a region where the heating roller 130 and the pressure roller 140 are in contact with each other is formed.

[Conveying Mechanism 60]

As shown in FIG. 8, the conveying mechanism 60 includes a feeding roller 62, a plurality of conveying rollers 64, the conveying belt 66, a driving roller 74, and a driven roller 76.

The feeding roller 62 is a roller that sends out the sheet member P accommodated in the accommodating portion 50 with an axial direction as the device depth direction. The plurality of conveying rollers 64 include a first conveying roller 64 that conveys the sheet member P, which is fed by the feeding roller 62, to the conveying belt 66, and a second conveying roller 64 that conveys the sheet member P, which is conveyed by the conveying belt 66, to the cooling unit 90.

The driving roller 74 is disposed on a side of the first conveying roller 64, that conveys the sheet member P fed by the feeding roller 62 to the conveying belt 66, with respect to the facing roller 36 with an axial direction as the device depth direction, and is rotated by a rotational force transmitted from a motor.

The driven roller 76 is disposed on a side of the cooling unit 90 with respect to the facing roller 36 with an axial direction as the device depth direction, and is rotatably supported and rotated.

The conveying belt 66 has an endless shape, is wound around the facing roller 36, the driving roller 74, and the driven roller 76, and rotates in a direction indicated by an arrow C as the driving roller 74 rotates. Further, in a rotating direction of the conveying belt 66, a part of the outer peripheral surface 66*a* of the conveying belt 66 from the facing roller 36 to the driven roller 76 faces upward. The upward facing portion of the conveying belt 66 faces the preheating unit 102 in the upper lower direction. Further, a width of the conveying belt 66 is wider than a width of the sheet member P.

A charging member (not shown) that charges the outer peripheral surface 66*a* of the conveying belt 66 is provided, and the rotating conveying belt 66 conveys the sheet member P by electrostatically attracting the sheet member P to the outer peripheral surface 66*a*. The outer peripheral surface 66*a* is a contact surface, for example.

Figure 3:
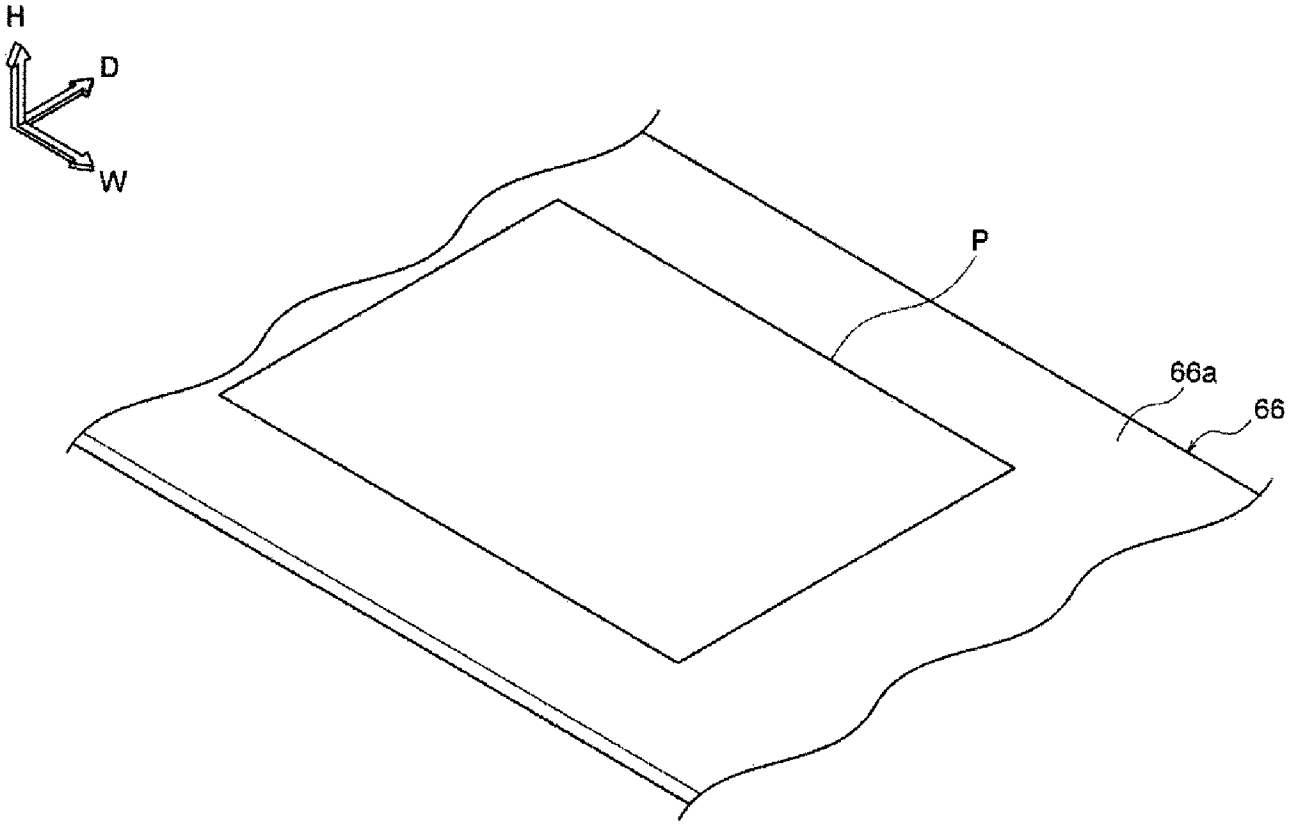
FIG. 3 is a perspective view showing a conveying belt of the image forming device according to the exemplary embodiment of the present invention.

As shown in FIG. 3, a portion of the conveying belt 66 that is in contact with the sheet member P is not provided with a through hole that penetrates the front and back of the conveying belt 66. In other words, an entire back surface of the sheet member P and the outer peripheral surface 66*a* of the conveying belt 66 are in contact with each other.

The outer peripheral surface 66*a* of the conveying belt 66 is formed of a material whose emissivity for infrared rays having a wavelength of 3 μm or more and 5 μm or less is 0.05 or less. In other words, the outer peripheral surface 66*a* of the conveying belt 66 is formed of a material whose temperature is less likely to rise by infrared rays having a wavelength of 3 μm or more and 5 μm or less as compared with a case where the outer peripheral surface 66*a* of the conveying belt 66 is formed of a material whose emissivity for infrared rays having a wavelength of 3 μm or more and 5 μm or less is more than 0.05. Examples of the material whose temperature is less likely to rise by infrared rays having a wavelength of 3 μm or more and 5 μm or less include metals such as silver, gold, aluminum, copper, and tin.

For example, an infrared reflecting film that reflects infrared rays having a wavelength of 3 μm or more and 5 μm or less may be formed on the outer peripheral surface 66*a* of the conveying belt 66 by depositing the metal on the conveying belt 66. Alternatively, an infrared reflecting film may be formed on the outer peripheral surface 66*a* of the conveying belt 66 by plating.

The emissivity (absorptance) of infrared rays may be measured using a emissivity measuring device (TSS-5X-2 manufactured by Japan Sensor Co., Ltd.).

In the configuration, the rotating conveying belt 66 receives the sheet member P conveyed by the plurality of conveying rollers 64 and conveys the sheet member P to the second transfer position NT. Specifically, the sheet member P is electrostatically attracted to the outer peripheral surface 66*a*, the conveying belt 66 rotates in the direction indicated by the arrow C, and thus the rotating conveying belt 66 conveys the sheet member P.

After the sheet member P electrostatically attracted to the outer peripheral surface 66*a* passes below the preheating unit 102, the rotating conveying belt 66 conveys the sheet member P toward a main heating unit 120 side. Here, a destaticizing unit (not shown) facing the outer peripheral surface 66*a* is provided downstream of the nip portion N in the conveying direction of the sheet member P. For example, the destaticizing unit is a needle-shaped electrode plate, and destaticizes the conveying belt 66 by applying a voltage, whose polarity is opposite to that in the charging of the conveying belt 66, from a power supply device. Thus, electrostatic attraction force between the sheet member P and the conveying belt 66 may be weakened. Then, the sheet member P is separated from the conveying belt 66 due to curvature of the driven roller 76. However, a configuration of the destaticizing unit is not limited to the exemplary embodiment as long as the conveying belt 66 is destaticized. For example, a configuration may be adopted in which a destaticizing brush is in contact with the outer peripheral surface 66*a*. Further, if the electrostatic attraction force between the sheet member P and the conveying belt 66 is weakened, a configuration may be adopted in which a peeling claw having no destaticizing function is in contact with the outer peripheral surface 66*a*.

In this way, a conveying unit 68 that conveys the sheet member P while rotating is configured with the conveying belt 66, the facing roller 36, the driving roller 74, and the driven roller 76 shown in FIG. 8. The facing roller 36, the driving roller 74, and the driven roller 76 are examples of a roller.

Here, as described above, infrared rays having a peak wavelength of 3 μm or more and 5 μm or less are radiated from the heaters 106 of the preheating unit 102. In other words, infrared rays having a maximum spectral radiance at a wavelength of 3 μm or more and 5 μm or less are radiated from the heaters 106. Further, the outer peripheral surface 66*a* of the conveying belt 66 is made of a material whose emissivity for infrared rays having a wavelength of 3 μm or more and 5 μm or less is 0.05 or less.

Thus, when the sheet member P is heated by the preheating unit 102, a maximum temperature of a portion of the outer peripheral surface 66*a* of the conveying belt 66 that is in contact with the sheet member P is equal to or lower than the temperature of the sheet member P. In other words, the outer peripheral surface 66*a* of the conveying belt 66 is formed of a material which makes a maximum temperature of a portion in contact with the sheet member P be equal to or lower than the temperature of the sheet member P when the sheet member P is heated by the preheating unit 102.

Here, the "temperature of the sheet member P" is a temperature of the sheet member P when the sheet member P is heated by the preheating unit 102, and is measured using, for example, a non-contact temperature sensor or the like.

The "maximum temperature of a portion of the outer peripheral surface 66*a* of the conveying belt 66 that is in contact with the sheet member P" will be described. The conveying belt 66 rotates and changes a portion thereof facing the preheating unit 102. Therefore, a temperature of the rotating conveying belt 66 rises each time the conveying belt 66 rotates one cycle. However, when a certain period of time elapses, an amount of heat absorbed by the conveying belt 66 and an amount of heat dissipated from the conveying belt 66 are the same (saturated state), and the temperature rise of the conveying belt 66 stops.

Therefore, the "maximum temperature of a portion of the outer peripheral surface 66*a* of the conveying belt 66 that is in contact with the sheet member P" is a temperature when the temperature rise of this portion stops. From experiments so far, after 5 min since the measurement target portion of the conveying belt 66 first passes the preheating unit 102, the temperature rise of this portion stops. That is, the "maximum temperature of a portion of the outer peripheral surface 66*a* of the conveying belt 66 that is in contact with the sheet member P" is a temperature after 5 min since the measurement target portion of the conveying belt 66 first passes the preheating unit 102. The maximum temperature is measured, for example, by attaching a thermocouple to the measurement target portion.

(Operation of Main Part Configuration)

Next, an operation of the image forming device 10 will be described in comparison with an image forming device 510 according to a comparative embodiment. First, for a configuration of the image forming device 510 according to the comparative embodiment, a part different from that of the image forming device 10 will be described mainly. For an operation of the image forming device 510, a part different from that of the image forming device 10 will also be described mainly.

[Image Forming Device 510]

Figure 9:
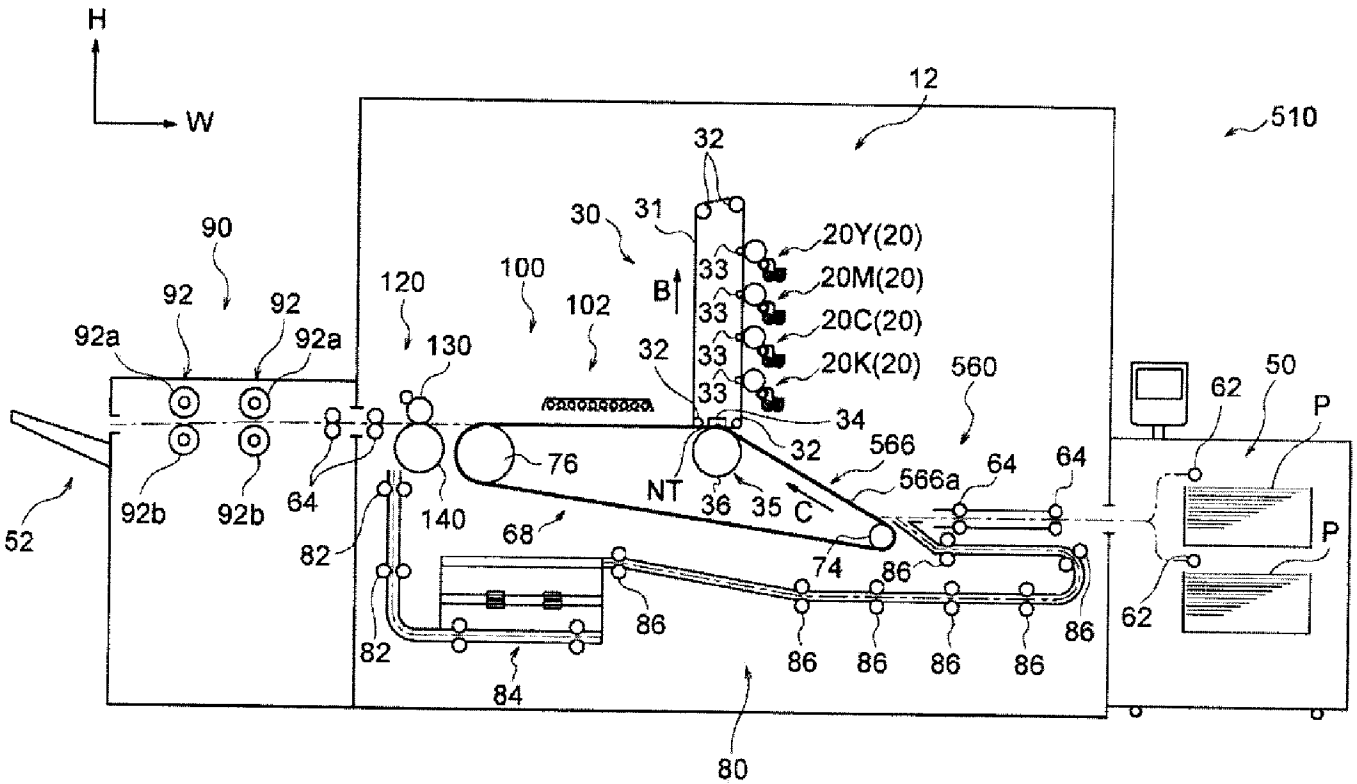
FIG. 9 is a schematic configuration diagram showing an image forming device according to a comparative embodiment of the present invention.

As shown in FIG. 9, the image forming device 510 includes the accommodating portion 50, the discharge portion 52, the image forming unit 12, a conveying mechanism 560, the reversing mechanism 80, the fixing device 100, and the cooling unit 90. The conveying mechanism 560 includes the feeding roller 62, a plurality of conveying rollers 64, a conveying belt 566, the driving roller 74, and the driven roller 76.

An outer peripheral surface 566*a* of the conveying belt 566 is formed using ethylene-propylene-diene rubber (EPDM rubber). Thus, the outer peripheral surface 566*a* of the conveying belt 566 is formed using a material whose emissivity for infrared rays having a wavelength of 3 μm or more and 5 μm or less is 0.9.

In the configuration, when the preheating unit 102 heats the sheet member P, the outer peripheral surface 566*a* of the conveying belt 566 on which the sheet member P is electrostatically attracted is also heated. The conveying belt 566 is heated by the preheating unit 102 while rotating, and a temperature of the conveying belt 566 gradually rises.

When the preheating portion 102 heats the sheet member P, if an amount of heat absorbed by the conveying belt 566 from the preheating unit 102 and an amount of heat dissipated from the conveying belt 566 is equal to each other, the temperature rise of the conveying belt 566 stops. Here, since the outer peripheral surface 566*a* of the conveying belt 566 is made of EPDM rubber whose emissivity is 0.9, the amount of heat absorbed by the conveying belt 566 from the preheating unit 102 is larger than the amount of heat absorbed by the conveying belt 66 from the preheating unit 102. Therefore, a maximum temperature of a portion of the conveying belt 566 that is in contact with the sheet member P is higher than a temperature of the sheet member P.

(Operations of Image Forming Devices 10, 510)

In the image forming device 10 or 510 shown in FIG. 8 or 9, the sheet member P conveyed by the feeding roller 62 and the conveying rollers 64 is electrostatically attracted to the outer peripheral surface 66*a* or 566*a* of the rotating conveying belt 66 or 566 and is sent to the second transfer position NT. At the second transfer position NT, the transfer belt 31 and the facing roller 36 sandwich the sheet member P electrostatically attracted to the outer peripheral surface 66*a* or 566*a* of the conveying belt 66 or 566, and thus the toner image on the surface of the transfer belt 31 is transferred to the sheet member P.

Further, the rotating conveying belt 66 or 566 conveys the sheet member P to which the toner image is transferred to the preheating unit 102. Then, the preheating unit 102 heats, in a non-contact state, the sheet member P conveyed by the conveying belt 66 or 566.

Further, by sandwiching and conveying the sheet member, that is heated by the preheating unit 102, between the heating roller 130 and the pressure roller 140, the main heating unit 120 fixes the toner image to the sheet member P. The sheet member P on which the toner image is fixed is conveyed to the cooling unit 90, and the cooling unit 90 cools the sheet member P on which the toner image is fixed and discharges the sheet member P to the discharge portion 52.

In a case of forming a toner image on a plurality of sheet members P, the above-described steps are repeated.

Here, the conveying belt 66 or 566 rotates and changes a portion thereof facing the preheating unit 102. Therefore, the temperature of the conveying belt 66 or 566 gradually rises each time the conveying belt 66 or 566 rotate one cycle.

The outer peripheral surface 566*a* of the conveying belt 566 of the image forming device 510 is formed using EPDM rubber. Therefore, as described above, the maximum temperature of the portion of the conveying belt 566 that is in contact with the sheet member P is higher than the temperature of the sheet member P. Thus, when the preheating unit 102 heats the sheet member P, heat is transferred from the conveying belt 566 to the sheet member P. Therefore, in the case of forming a toner image on a plurality of sheet members P, the temperature of the sheet member P to be conveyed to the main heating unit 120 increases as the number of sheets increases.

Therefore, in the case of forming a toner image on a plurality of sheet members P, a difference between glossiness (gloss) of a toner image on the first sheet member P and glossiness of the toner image on the 100th sheet member P is generated.

Meanwhile, for the conveying belt 66 of the image forming device 10, the outer peripheral surface 66*a* of the conveying belt 66 is formed using a material whose temperature is less likely to rise by infrared rays having a wavelength of 3 μm or more and 5 μm or less. Therefore, as described above, the maximum temperature of the portion of the conveying belt 66 that is in contact with the sheet member P is equal to or lower than the temperature of the sheet member P.

Thus, when the preheating unit 102 heats the sheet member P, heat is not transferred from the conveying belt 66 to the sheet member P. Therefore, in the case of forming a toner image on a plurality of sheet members P, it is possible to prevent the temperature of the sheet member P to be conveyed to the main heating unit 120 from increasing as the number of sheets increases.

Therefore, in the case of forming a toner image on a plurality of sheet members P, generation of the difference between the glossiness of the toner image on the first sheet member P and the glossiness of the toner image on the 100th sheet member P is prevented.

(Overview)

As described above, in the image forming device 10, generation of a difference between glossiness of a toner image formed on a first sheet member P and glossiness of a toner image formed on a 100th sheet member P is prevented as compared with the image forming device 510.

In the image forming device 10, the outer peripheral surface 66*a* of the conveying belt 66 is formed of a material whose emissivity for infrared rays having a wavelength of 3 μm or more and 5 μm or less is 0.05 or less. Therefore, as compared with a case where the outer peripheral surface is formed of a material whose emissivity for infrared rays having a wavelength of 3 μm or more and 5 μm or less is greater than 0.05, generation of the difference between the glossiness of the toner image formed on the first sheet member P and the glossiness of the toner image formed on the 100th sheet member P is prevented.

In the image forming device 10, when the outer peripheral surface 66*a* is formed using silver, generation of a difference between glossiness of a toner image formed on a first sheet member P and glossiness of a toner image formed on a 100th sheet member P is prevented as compared with a case where the outer peripheral surface 66*a* is formed using EPDM rubber whose emissivity is 0.9.

In the image forming device 10, the conveying unit 68 conveys the sheet member P in a state where the back surface of the sheet member P and the outer peripheral surface 66*a* of the conveying belt 66 are in contact with each other. Therefore, for example, as compared with a case where the sheet member P is conveyed in a state where only both end portions and a central portion of the back surface of the sheet member P in a width direction thereof are in contact with a wire, since there is no temperature difference between a portion of the sheet member P in contact with the wire and a portion of the sheet member P not in contact with the wire, generation of gloss unevenness on the toner image is prevented.

In the image forming device 10, a through hole penetrating the front and back is not formed in a portion of the conveying belt 66 that is in contact with the sheet member P. In other words, the conveying unit 68 conveys the sheet member P in a state where an entire back surface of the sheet member P and the outer peripheral surface 66*a* of the conveying belt 66 are in contact with each other. Therefore, for example, as compared with a case where through holes penetrating the front and back are formed in the conveying belt, such as a conveying belt that attracts the sheet member P by suction, there is no temperature difference between a portion of the sheet member P that is in contact with the outer peripheral surface of the conveying belt 66 and a portion of the sheet member P that is not in contact with the outer peripheral surface of the conveying belt 66 due to the formation of the through hole, so that generation of gloss unevenness on the toner image is prevented.

Although the present invention has been described in detail with reference to a specific embodiment, the present invention is not limited to the embodiment, and various other embodiments may be adopted within the scope of the present invention. For example, in the above-described embodiment, the outer peripheral surface 66*a* of the conveying belt 66 is formed of a material whose emissivity for infrared rays having a wavelength of 3 μm or more and 5 μm or less is 0.05 or less, but the outer peripheral surface may be formed using another member as long as the maximum temperature of the portion of the outer peripheral surface 66*a* of the conveying belt 66 that is in contact with the sheet member P is equal to or lower than the temperature of the sheet member P when the preheating unit 102 heats the sheet member P.

Further, in the above-described embodiment, the outer peripheral surface 66*a* of the conveying belt 66 may be made of another metal material such as silver, gold, aluminum, copper, tin as long as emissivity of the material for infrared rays having a wavelength of 3 or more and 5 μm or less is 0.05 or less.

In the above-described embodiment, the sheet member P is attracted to the outer peripheral surface 66*a* of the endless conveying belt 66, but for example, the sheet member P may be attracted to an outer peripheral surface of the facing roller. In this case, the heaters of the preheating unit are arranged in an arc shape along the outer peripheral surface of the facing roller.

Further, a cooling means for cooling the outer peripheral surface 66*a* of the conveying belt 66 may be provided. By providing the cooling means, temperature rise of the conveying belt 66 may be stopped at a lower temperature. As the cooling means, for example, a cooling fan that cools the conveying belt 66 by applying air from an outer peripheral surface side or an inner peripheral surface side of the conveying belt 66 may be provided. The cooling fan may be provided so as to apply air to a region where the sheet member P is conveyed in a state where the sheet member P is electrostatically attracted to the outer peripheral surface 66*a* of the conveying belt 66, but it is preferable to provide the cooling fan so as to apply air to a region other than the outer peripheral surface 66*a* of the conveying belt 66 to which the conveyed sheet member P is electrostatically attracted, in order to prevent the conveying state of the sheet member P from becoming unstable due to the air.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

a conveying unit configured to convey a recording medium while rotating, in a state of being in contact with a back surface of the recording medium having a front surface where a toner image is transferred;

a main heating unit configured to heat the conveyed recording medium to fix the toner image on the recording medium; and a preheating unit disposed upstream of the main heating unit in a conveying direction of the recording medium and configured to heat, in a non-contact state, the recording medium being conveyed by the conveying unit, wherein a portion of the conveying unit that is in contact with the recording medium is formed of a material that makes a maximum temperature of the portion be equal to or lower than a temperature of the recording medium when the recording medium is heated by the preheating unit, the preheating unit comprises an infrared heater configured to emit, to the recording medium, infrared rays having maximum spectral radiance at a wavelength of 3 μm or more and 5 μm or less, and the conveying unit has a contact surface that is in contact with the recording medium, and the contact surface is formed of a material whose emissivity for infrared rays having a wavelength of 3 μm or more and 5 μm or less is 0.05 or less.

2. The image forming device according to claim 1, wherein the contact surface is formed of silver, gold, aluminum, copper, or tin.

3. The image forming device according to claim 1, wherein the conveying unit comprises:

a plurality of rollers; and an endless conveying belt wound around the rollers, and the conveying unit is configured to convey the recording medium in a state where an outer peripheral surface of the conveying belt and the back surface of the recording medium are in contact with each other, the outer peripheral surface of the conveying belt being a contact surface that is in contact with the recording medium.

4. The image forming device according to claim 2, wherein the conveying unit comprises:

a plurality of rollers; and an endless conveying belt wound around the rollers, and the conveying unit is configured to convey the recording medium in a state where an outer peripheral surface of the conveying belt, that is the contact surface, and the back surface of the recording medium are in contact with each other.

5. The image forming device according to claim 3, wherein the conveying unit conveys the recording medium in a state where an entire back surface of the recording medium and the outer peripheral surface of the conveying belt are in contact with each other.

6. The image forming device according to claim 4, wherein the conveying unit conveys the recording medium in a state where an entire back surface of the recording medium and the outer peripheral surface of the conveying belt are in contact with each other.

7. The image forming device according to claim 1, further comprising:

an infrared reflecting film on the portion of the conveying unit that is in contact with the recording medium, the infrared reflecting film being configured to reflect infrared rays having a wavelength of 3 μm or more and 5 μm or less.

8. The image forming device according to claim 7, wherein the infrared reflecting film is formed of silver, gold, aluminum, copper, or tin.

9. The image forming device according to claim 7, wherein the conveying unit comprises:

a plurality of rollers; and an endless conveying belt wound around the rollers, the infrared reflecting film is provided on an outer peripheral surface of the conveying belt, and the conveying unit conveys the recording medium in a state where the infrared reflecting film and the back surface of the recording medium are in contact with each other.

10. The image forming device according to claim 8, wherein the conveying unit comprises:

a plurality of rollers; and an endless conveying belt wound around the rollers, the infrared reflecting film is provided on an outer peripheral surface of the conveying belt, and the conveying unit conveys the recording medium in a state where the infrared reflecting film and the back surface of the recording medium are in contact with each other.

11. The image forming device according to claim 9, wherein the conveying unit conveys a recording medium in a state where an entire back surface of the recording medium and the infrared reflecting film are in contact with each other.

12. The image forming device according to claim 10, wherein the conveying unit conveys a recording medium in a state where an entire back surface of the recording medium and the infrared reflecting film are in contact with each other.

* * * * *